United States Patent [19]

Johnston et al.

[11] Patent Number: 4,518,642

[45] Date of Patent: May 21, 1985

[54] LOUDSPEAKER DIAPHRAGM AND METHOD FOR MAKING SAME

[75] Inventors: George C. Johnston, Clinton, N.C.; Michael A. Swieboda, Hickory Hills, Ill.

[73] Assignee: International Jensen Incorporated, Schiller Park, Ill.

[21] Appl. No.: 483,308

[22] Filed: Apr. 15, 1983

[51] Int. Cl.[3] ..... D04H 1/04

[52] U.S. Cl. ..... 428/172; 181/167; 181/169; 181/170; 428/288; 428/296; 264/119; 264/122; 264/126

[58] Field of Search ..... 428/288, 296, 156, 172; 181/167, 169, 170; 264/119, 122, 126

[56] References Cited

U.S. PATENT DOCUMENTS

| | | | |
|---|---|---|---|
| 3,935,924 | 2/1976 | Nagao et al. | 181/169 |
| 4,190,746 | 2/1980 | Harwood et al. | 179/115.5 R |
| 4,291,781 | 9/1981 | Niguchi et al. | 181/169 |

FOREIGN PATENT DOCUMENTS

| | | | |
|---|---|---|---|
| 53-24811 | 7/1978 | Japan | 181/169 |
| 54-155825 | 12/1979 | Japan | 181/169 |
| 55-141895 | 11/1980 | Japan | 181/169 |
| 1452118 | 10/1976 | United Kingdom | 181/169 |
| 2027122A | 7/1980 | United Kingdom . | |

OTHER PUBLICATIONS

Reinforced Olefin Polymer Diaphragm for Loudspeakers, Journal Audio Engineering Society, vol. 29, No. 11, pp. 808–813.

The Design and Manufacture of Loudspeaker Cones–An Introduction, George C. Johnston, (Preprint No. 919, (A-4), May 15, 1973).

"Reinforced Olefin Diaphragms for Speakers", National Technical Report, vol. 25, No. 5, (Oct. 1979).

*Primary Examiner*—Marion E. McCamish

*Attorney, Agent, or Firm*—Willian Brinks Olds Hofer Gilson & Lione Ltd.

[57] ABSTRACT

A loudspeaker diaphragm is disclosed which is formed of a slurry of cellulose fibers and polypropylene fibers. In the fabrication of the diaphragm, a felt is made of the slurry, and the felt is subjected to sufficient heat and pressure to fuse the polypropylene fibers together to form a skeleton or matrix which extends through the felt.

12 Claims, 7 Drawing Figures

LOUDSPEAKER DIAPHRAGM AND METHOD FOR MAKING SAME

BACKGROUND OF THE INVENTION

The present invention relates to an improved diaphragm for loudspeakers, such as moving coil loudspeakers, and to a method for making this improved diaphragm.

Loudspeakers play a critical role in determining the fidelity of sound systems, and loudspeaker diaphragms play a critical role in the performance of loudspeakers. A wide variety of materials have been used in the past to construct loudspeaker diaphragms, including paper, polypropylene, various metals, treated paper, and mixtures of polypropylene and carbon fibers. The article entitled "Reinforced Olefin Polymer Diaphragm for Loudspeakers" (J. Audio Eng. Soc., Vol. 29, No. 11, pp. 808–813, Nov. 1981) describes several polypropylene/-carbon fiber diaphragms. Each of these materials has advantages and disadvantages, but in general each represents a compromise among several desired diaphragm characteristics, including high stiffness, low mass, insensitivity to temperature and humidity variations, and low manufacturing cost.

Paper loudspeaker diaphragms have been in widespread use for a considerable time period. Such paper diaphragms provide advantages in terms of inexpensive manufacture and relatively good sensitivity in view of their relatively low mass. However, paper diaphragms can exhibit a relatively low stiffness which can adversely affect the frequency response of the diaphragm. In addition, paper diaphragms are generally moisture-sensitive, and the acoustical properties of paper diaphragms are typically affected by variations in humidity. Moreover, paper diaphragms can become brittle and crack over time, particularly when repeatedly cycled over extremes of temperature.

Polypropylene loudspeaker diaphragms have been described, for example, in U.S. Pat. No. 4,190,746. In general, such polypropylene loudspeaker diaphragms can be manufactured with good frequency response characteristics in view of the relative stiffness of polypropylene. However, polypropylene is a relatively expensive component material as compared with paper, and it can present difficulties in manufacture. In particular, adhesives which are suitable for use with paper diaphragms are often unsatisfactory for use with polypropylene diaphragms. In addition, polypropylene diaphragms, although relatively insensitive to moisture, can be adversely affected by relatively low temperatures. When polypropylene diaphragms are heated (as, for example, when positioned on the rear deck of an automobile) they may be distorted by elevated temperatures, and may tend to relax away from the manufactured shape. In some cases, polypropylene diaphragms have been made with increased thickness in order to allow the diaphragm to tolerate higher temperatures without distortion. However, such increased thickness will typically increase the mass of the diaphragm, thereby reducing its sensitivity.

Thus, both paper and polypropylene diaphragms exhibit undesirable characteristics which may cause problems in many applications.

SUMMARY OF THE INVENTION

The present invention is directed to an improved loudspeaker diaphragm which, to a large extent, overcomes many of the disadvantages of paper and polypropylene diaphragms described above, and to a method for manufacturing such an improved diaphragm.

According to this invention, a loudspeaker diaphragm is provided which comprises a diaphragm element comprising a felt of a mixture of paper-making fibers and thermoplastic fibers, in which the thermoplastic fibers are fused together to form a matrix of thermoplastic material which extends through the felt to stiffen the diaphragm element. In the preferred embodiment described below, the paper-making fibers comprise cellulose fibers, the thermoplastic fibers comprise polypropylene fibers, and the ratio of the dry weight of the polypropylene fibers to the dry weight of the cellulose fibers is in the range of about 0.2 to about 0.3. As used herein, the term "paper-making fibers" is used to encompass the range of fibers used in paper making, including wood fibers, other cellulose fibers, cotton, linen, and wool fibers.

According to the method of this invention, a diaphragm for a loudspeaker is formed by first providing a slurry comprising a mixture of paper-making fibers and thermoplastic fibers. Then a felt is formed of the slurry and sufficient heat is applied to the felt to fuse the thermoplastic fibers in the felt in order to bond the paper-making fibers together mechanically. The felt is formed between two opposed dies to shape the felt to a desired configuration suitable for a loudspeaker diaphragm.

The diaphragm and method for making a diaphragm of this invention provide a number of important advantages. In laboratory measurements, a presently preferred embodiment of the improved diaphragm of this invention has been compared with certain paper diaphragms of the prior art. These tests have shown that the improved diaphragm of this invention provides a smoother frequency response and is less sensitive to changes in humidity than the prior art paper diaphragm. In additional laboratory tests, this preferred embodiment of the diaphragm of this invention was compared with a prior art polypropylene diaphragm. These additional tests demonstrated that the diaphragm of this invention was tolerant of higher temperatures than was the polypropylene diaphragm and was cheaper in terms of component materials than was the polypropylene diaphragm.

The improved diaphragm of this invention can be manufactured at a cost only slightly greater than that of paper diaphragms, yet it provides important advantages over paper diaphragms. In many ways, the improved diaphragm of this invention combines the advantageous frequency response and humidity insensitivity characteristics of polypropylene diaphragms with the advantageous low mass, low cost, and temperature characteristics of paper diaphragms. In this way, the improved diaphragm of this invention is superior in many ways both to paper and to polypropylene diaphragms.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
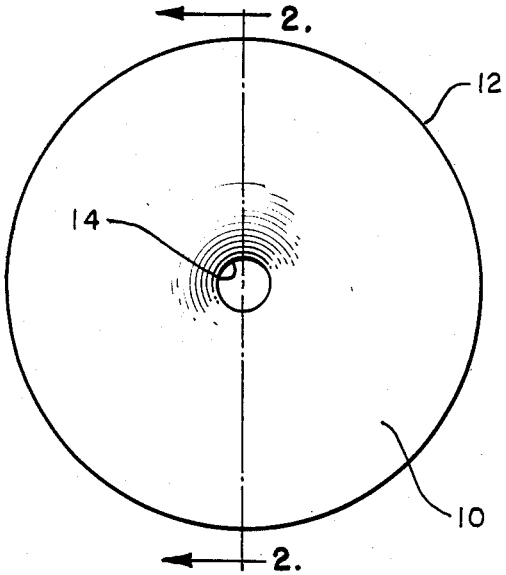
FIG. 1 is a front view of a diaphragm for a moving coil loudspeaker made in accordance with this invention.
Figure 2:
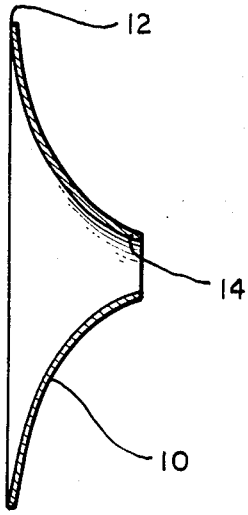
FIG. 2 is a sectional view taken along line 2—2 of FIG. 1.

Turning now to the drawings, FIGS. 1 and 2 show a loudspeaker diaphragm built in accordance with a presently preferred embodiment of this invention, and FIGS. 3*a*–3*e* show five steps in a presently preferred method for fabricating the diaphragm of FIG. 1.

In FIG. 1, the reference numeral 10 is used to designate a loudspeaker diaphragm. This diaphragm 10 defines an outer circular perimeter 12 and an inner circular perimeter 14. This diaphragm 10 can be used in the assembly of a conventional moving coil loudspeaker. In such a moving coil loudspeaker, it is customary to attach a surround (not shown) to the outer perimeter 12, which surround is mounted to a speaker frame (not shown). A spider (not shown) is used to center and locate the diaphragm 10, and the inner perimeter 14 is typically connected to a voice coil (not shown) which generates electromagnetic forces which serve to drive the diaphragm 10. Typically, a dust cap (not shown) is placed over the aperture defined by the inner parimeter 14. Elements such as surrounds, spiders, dust caps, voice coils and magnets do not form part of this invention and are therefore not disclosed in any detail here. The above-referenced U.S. Pat. No. 4,190,746 can be referenced for a depiction of the general features of one type of moving coil loudspeaker suitable for use with the diaphragm 10. However, it should be understood clearly that the present invention is directed to an improved loudspeaker diaphragm, not to a particular type of loudspeaker, and diaphragms of this invention can be used with a wide variety of loudspeakers, including piezoelectric as well as various types of moving coil loudspeakers.

The diaphragm 10 is formed of a felt which in this preferred embodiment is formed of a mixture of cellulose fibers and polypropylene fibers. As described below, the polypropylene fibers are mixed with the cellulose fibers, formed into the desired shape for the diaphragm 10, and the polypropylene fibers are fused together to form a matrix or skeleton extending throughout the felt of the diaphragm 10 in order to strengthen and stiffen it.

In fabricating the diaphragm of this invention a wide variety of paper making fibers can be used. For example, kraft, sulphite and cotton fibers can be used, either alone or in combination, to make up the cellulose fiber constituent of the felt.

Similarly, a wide variety of thermoplastic fibers are suitable for use with this invention. The length of these fibers is not believed to be critical, and fibers of both 5 and 10 millimeters in length have been used successfully. In this preferred embodiment, polypropylene staple fibers distributed by Hercules Incorporated, North Cross, Georgia as Item No. T-153 (3 dpf by 5 mm) have been found to be suitable. Furthermore, the ratio of thermoplastic fibers to paper-making fibers can be varied broadly, at least within the range of 10% to 50% thermoplastic fiber (dry weight) to paper-making fiber (dry weight). In the presently preferred embodiment, the preferred ratio of the dry weight of the above-identified polypropylene fibers to the dry weight of the paper-making fibers is in the range of 0.2 to 0.3. A ratio of 0.25 is particularly suitable for some applications.

Turning now to FIGS. 3*a*–3*e*, a presently preferred method for fabricating the diaphragm 10 will now be described. This method is similar in some respects to conventional methods for fabricating felted diaphragms, as described, for example, in the paper entitled "The Design and Manufacture of Loudspeaker Cones—An Introduction" by George C. Johnston (May 15–18, 1973, Convention of the Audio Engineering Society, Preprint No. 919 (A-4)). That paper should be referenced for general background.

The first step in the method of FIGS. 3*a*–3*e* is to form a pulp of paper-making fibers in the conventional manner. For example, kraft, sulphite or cotton fibers can be formed in a pulp which is beaten in the normal fashion and for a suitable length of time to obtain the desired freeness. The choice of the source of paper-making fibers should be made in accordance with well known principles as appropriate for the desired application. For example, a large proportion of cotton fibers will result in a relatively soft diaphragm, while a large proportion of kraft fibers will result in a hard diaphragm.

Solely by way of example, a suitable diaphragm can be formed from a pulp made of 100% bleached kraft fibers such as the kraft fibers distributed by MacMillan Bloedell of British Columbia, Canada, under the trade name HARMAC. With this example, the kraft paper should be beaten in the conventional manner until the drainage rate of the pulp as measured in a Canadian Standard Freeness Tester is 600 cc. At this point in the process, thermoplastic fibers such as the above-identified polypropylene fibers are added to the pulp slurry in the desired concentration, and the thermoplastic fibers are mechanically mixed with the cellulose fibers. As explained above, in this exemplary embodiment the polypropylene fibers are mixed with cellulose fibers in a ratio of 1 to 3 (dry weight).

This slurry mixture is then sent to an automatic, turret-type molding machine where the actual molding and forming of the diaphragm 10 takes place. FIGS. 3*a*–3*e* illustrate the five stations of the molding process. In this exemplary embodiment, the pulp or felt remains for a period of about 20 seconds at each of the five stations.

Figure 3A:
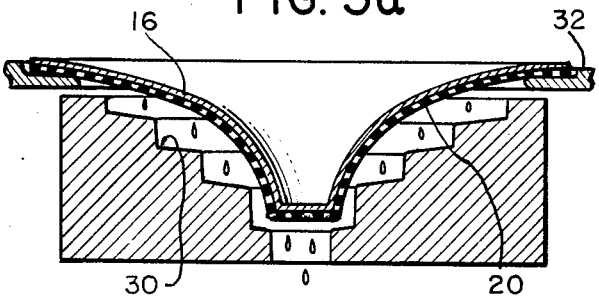
FIGS. 3*a*–3*e* are schematic sectional diagrams showing five successive steps in the manufacture of the diaphragm of FIG. 1.
Figure 3B:
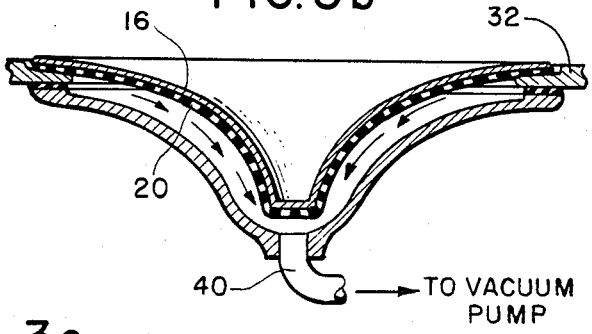
Figure 3C:
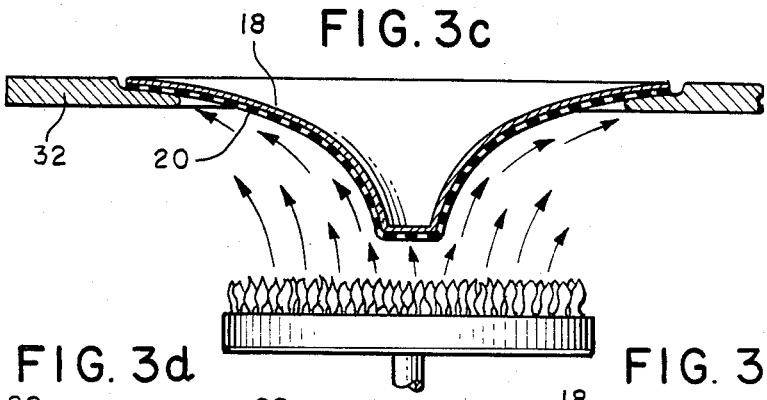

The first step in the forming process is to form a layer of pulp 16 from the slurry on a screen 20, as shown in FIG. 3*a*. This screen 20 is formed in the desired end shape of the diaphragm 10 and is provided with a multiplicity of apertures. The screen 20 is of the type commonly used in the molding of paper loudspeaker diaphragms. After the pulp 16 has been deposited on the interior of the screen 20, it is allowed to drain or drip dry for a period of about 20 seconds in a well 30.

After this period of draining, the screen 20, which is supported by turret 32 and in turn supports the pulp 16, is moved to a second station (FIG. 3*b*) which is coupled via a central conduit 40 to a vacuum pump. This vacuum pump serves to pull air at room temperature and humidity through the pulp 16 and the screen 20 to dry the pulp 16 to form a layer of felt 18. In this exemplary embodiment, the screen 20 and pulp 16 remain in the second station of FIG. 3*b* for a period of 20 seconds.

At the end of the dehydration step, the screen 20 with the felt 18 supported thereon is moved to a third station (FIG. 3*c*) in which the screen 20 is placed over a gas flame. This gas flame is distributed over the underside of the screen 20 and is typically positioned such that the flame reaches within one-half inch of the screen 20. The flame should be adjusted to dry the felt 18 rapidly and evenly. In the event the felt scorches, the flame should be lowered as necessary to prevent scorching. The screen 20 and felt 18 remain in the station of FIG. 3*c* for 20 seconds until the felt 18 is substantially dry. As explained above, the felt is made up of a mixture of paper making fibers and thermoplastic fibers.

Figure 3D:
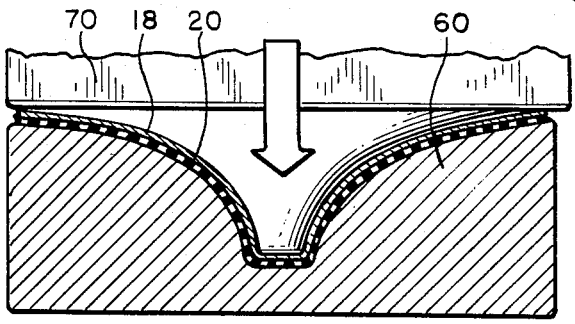

At the end of the drying step, the screen 20 and felt 18 are moved to a fourth station as shown in FIG. 3*d*. In this fourth station, the screen 20 is placed on a lower die 60 formed in the shape of the diaphragm 10. Then an upper die 70 is caused to move downwardly into contact with the felt 18 supported by the screen 20. Thus, the felt 18 and screen 20 are captured between the upper and lower dies 70, 60. These dies are heated to a temperature of about 250° C. in this embodiment and sufficient pressure is applied to form the felt closely to the shape of the upper die 70. In this pressing step, the thermoplastic fibers within the felt 18 are heated to the point where they fuse together, thereby forming a skeleton or matrix extending throughout the felt 18. This skeleton or matrix of fused thermoplastic material gives stiffness and rigidity to the resulting diaphragm. At the end of the step illustrated in FIG. 3*d*, the felt 18 has taken on the shape of the diaphragm 10. In this embodiment the pressure exerted by the dies 60,70 is selected to reduce the thickness of the felt 18 from a prepressing thickness of 0.71 mm to a post-pressing thickness of 0.47 mm.

Figure 3E:
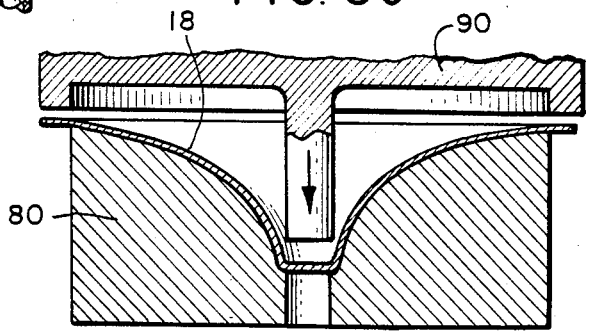

At this point, the felt 18 is removed from the screen 20 and placed between two shear dies 80,90 as shown in FIG. 3*e*. These shear dies perform a knockout punch operation in order to trim the felt 18 at the outer perimeter 12 and the inner perimeter 14 to form the diaphragm 10 to the desired dimensions. This last step of FIG. 3*e* is essentially a trimming step. After the step of FIG. 3*e* the diaphragm 10 is complete, ready to be assembled with other components to form a loudspeaker.

As explained above, a wide variety of paper-making fibers and thermoplastic fibers can be used in fabricating the diaphragm of this invention. However, regardless of the materials, it is important that the thermoplastic fibers be fused together during the fabrication of the diaphragm in order to fuse individual thermoplastic fibers together to form a skeleton or matrix. It is this fused skeleton or matrix which is thought to be responsible for several of the advantageous features of the diaphragm of this invention.

From the foregoing description, it should be apparent that an improved loudspeaker diaphragm and a method for its fabrication have been described. The diaphragm of this invention is only slightly more expensive to manufacture than comparable paper diaphragms, yet it provides significant advantages over paper diaphragms in terms of improved moisture resistance and frequency response.

Of course, it should be understood that a wide range of changes and modifications to the preferred embodiments described above will be apparent to those skilled in the art. For example, a variety of thermoplastic and paper-making fibers can be used. Furthermore, it is not necessary in all applications first to mold a pulp into a diaphragm shape and then to heat-form it into the final shape. In alternate embodiments, a sheet of felt can be formed which is then heat-formed into the final diaphragm shape. It is therefore intended that the foregoing detailed description be regarded as illustrative rather than limiting, and that it be understood that it is the following claims, including all equivalents, which are intended to define the scope of this invention.

We claim:

1. A loudspeaker diaphragm comprising a diaphragm element comprising a felt of a mixture of cellulose fibers and polypropylene fibers, said polypropylene fibers being fused together to form a matrix of polypropylene which extends through the felt to stiffen the diaphragm element, the ratio of dry weight of the polypropylene fibers to dry weight of the cellulose fibers being in the range of about 0.1 to about 0.5.

2. The invention of claim 1 wherein the ratio of dry weight of the polypropylene fibers to the dry weight of the cellulose fibers is in the range of about 0.2 to about 0.3.

3. The invention of claim 1 wherein the diameter of the cellulose fibers is substantially equal to the diameter of the polypropylene fibers.

4. A loudspeaker diaphragm comprising a diaphragm element comprising a felt of a mixture of cellulose fibers and polypropylene fibers, wherein the ratio of the dry weight of the polypropylene fibers to the dry weight of the cellulose fibers is in the range of about 0.2 to about 0.3, said polypropylene fibers being fused together to form a matrix of fused polypropylene which extends throughout the felt to stiffen the diaphragm element.

5. A method for making a diaphragm for a loudspeaker comprising the following steps:

providing a slurry comprising a mixture of cellulose fibers and propylene fibers, wherein the ratio of the dry weight of the polypropylene fibers to the dry weight of the cellulose fibers is in the range of about 0.1 to about 0.5;

forming a felt of the slurry; and heat forming the felt between two opposed heated dies to fuse the thermoplastic fibers in the felt in order to mechanically bond the paper-making fibers together and to shape the felt to a desired configuration.

6. The invention of claim 2 wherein the ratio of the dry weight of polypropylene fibers to the dry weight of cellulose fibers is in the range of about 0.2 to about 0.3.

7. A diaphragm for a loudspeaker made in accordance with the method of claim 6.

8. A diaphragm for a loudspeaker made in accordance with the method of claim 1.

9. A method for making a diaphragm for a loudspeaker comprising the following steps:

providing a slurry comprising a mixture of cellulose fibers and polypropylene fibers, wherein the ratio between the dry weight of the polypropylene fibers and the dry weight of the cellulose fibers is in the range of about 0.1 to about 0.5:

molding a portion of the slurry on a screen to a concave shape;

dehydrating the molded slurry portion;

drying the dehydrated slurry portion to form a felt;

shaping the felt between a striking tool and a die at a selected pressure to form a diaphragm, said shaping step performed at a temperature selected to fuse the polypropylene fibers at the selected pressure to form a polypropylene matrix around the paper-making fibers in order to strengthen and stiffen the shaped felt.

10. The invention of claim 9 wherein the ratio of the dry weight of polypropylene fibers to the dry weight of cellulose fibers is in the range of about 0.2 to about 0.3.

11. A diaphragm for a loudspeaker made in accordance with the method of claim 10.

12. A diaphragm for a loudspeaker made in accordance with the method of claim 9.

* * * * *

UNITED STATES PATENT AND TRADEMARK OFFICE

CERTIFICATE OF CORRECTION

PATENT NO. : 4,518,642

DATED : May 21, 1985

INVENTOR(S) : GEORGE C. JOHNSTON ET AL

It is certified that error appears in the above-identified patent and that said Letters Patent is hereby corrected as shown below:

IN THE CLAIMS

In Claim 8 (Column 6, line 43), please delete "1" and substitute therefor --5--.

Signed and Sealed this

*Nineteenth* Day of *August 1986*

[SEAL]

*Attest:*

DONALD J. QUIGG

*Attesting Officer*

*Commissioner of Patents and Trademarks*